US007533763B2

(12) United States Patent
Kattainen et al.

(10) Patent No.: US 7,533,763 B2
(45) Date of Patent: May 19, 2009

(54) SAFETY DEVICE, SAFETY SYSTEM, AND METHOD FOR SUPERVISING SAFETY OF AN ELEVATOR SYSTEM

(75) Inventors: Ari Kattainen, Hyvinkää (FI); Timo Laasonen, Järvenpää (FI); Matti Räsänen, Hyvinkää (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/979,912

(22) Filed: Nov. 9, 2007

(65) Prior Publication Data

US 2008/0128217 A1 Jun. 5, 2008

Related U.S. Application Data

(63) Continuation of application No. PCT/FI2006/000027, filed on Jan. 31, 2006.

(30) Foreign Application Priority Data

Feb. 4, 2005 (FI) ..... 20050128

(51) Int. Cl.
*B66B 1/34* (2006.01)

(52) U.S. Cl. ..... 187/394; 187/287

(58) Field of Classification Search ..... 187/287, 187/291, 293, 294, 282, 284, 295, 393, 394
See application file for complete search history.

(56) References Cited

U.S. PATENT DOCUMENTS 5,035,301 A * 7/1991 Skalski ..... 187/295
5,266,757 A * 11/1993 Krapek et al. ..... 187/295
5,637,841 A * 6/1997 Dugan et al. ..... 187/294
5,869,794 A 2/1999 Spiess
6,032,761 A * 3/2000 Coste et al. ..... 187/294
6,253,879 B1 7/2001 Skalski et al.

FOREIGN PATENT DOCUMENTS

EP 1 431 229 A1 6/2004
WO WO 00/39015 7/2000
WO WO 2004/031064 A1 4/2004

* cited by examiner

*Primary Examiner*—Jonathan Salata
(74) *Attorney, Agent, or Firm*—Harness, Dickey & Pierce, P.L.C.

(57) ABSTRACT

A safety system for supervising safety of an elevator may include a safety space in an elevator shaft, elevator buffers in the elevator shaft, or both; measuring means for continuous measurement of absolute position of an elevator car; and a safety device. If the safety system includes the safety space, its size may be reduced. If the safety system includes the elevator buffers, their size may be reduced. The safety device may be adapted to receive data about the absolute position of the elevator car; calculate a velocity of the elevator car at each instant of time using the absolute position; monitor the calculated velocity in order to ensure that the calculated velocity remains within an allowed motion limit curve; and control at least one stopping device for stopping uncontrolled motion of the elevator car if the calculated velocity exceeds the allowed motion limit curve.

28 Claims, 6 Drawing Sheets

Figure 1:
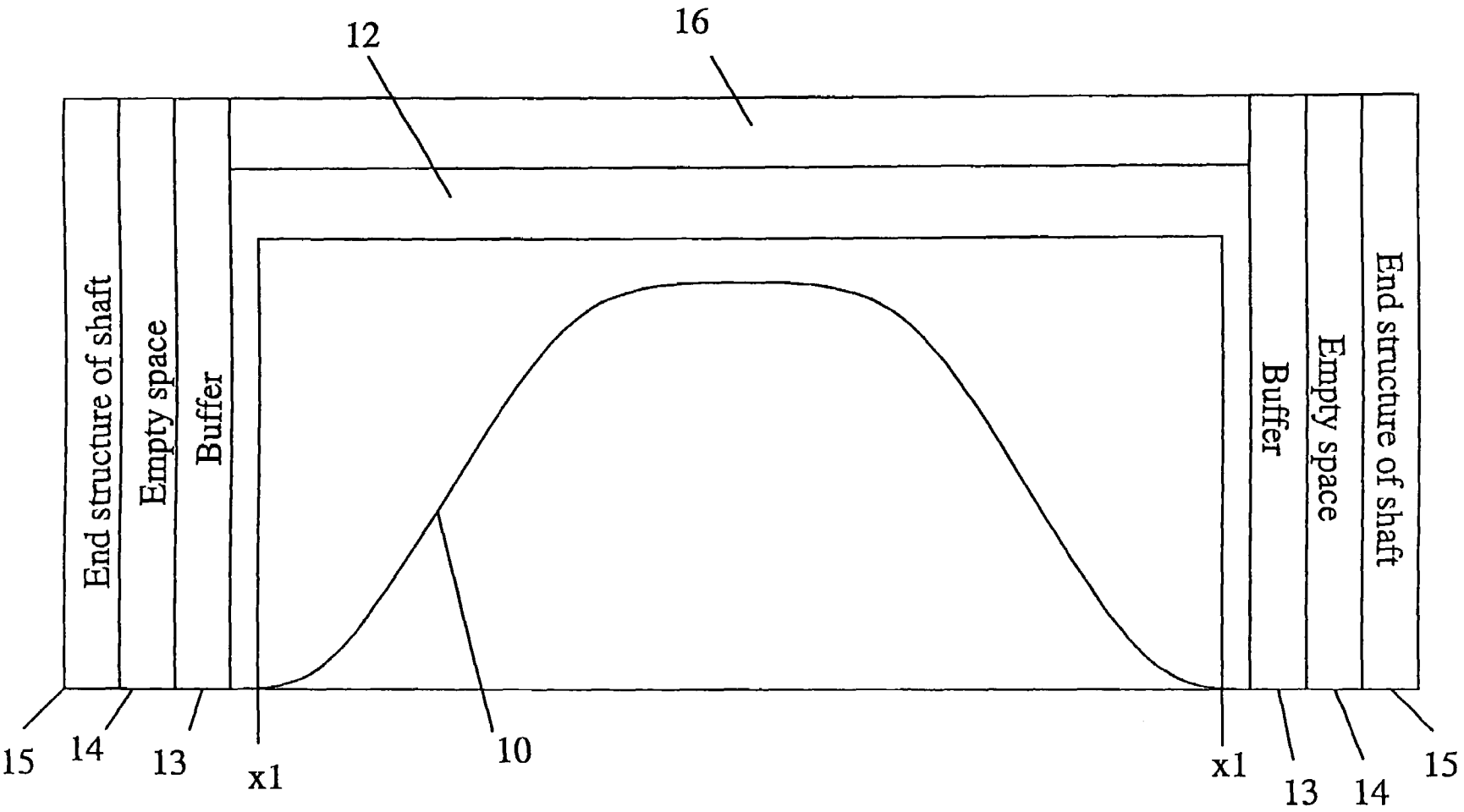
Fig.1 (Related Art)

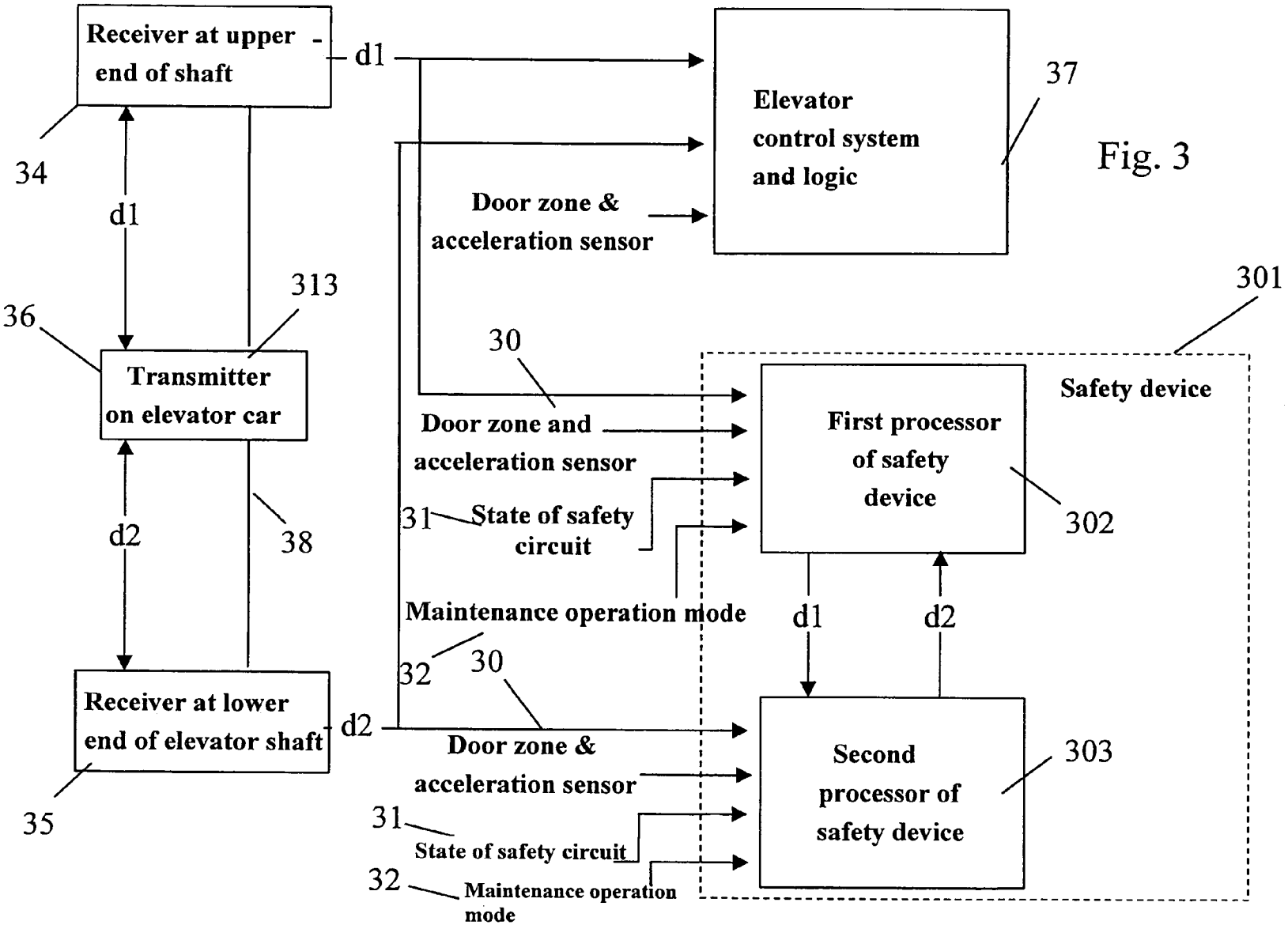
Fig. 3
301
Safety device
37
Elevator control system and logic
302
First processor of safety device
303
Second processor of safety device
d2
d1
Door zone & acceleration sensor
30
Door zone and acceleration sensor
31
State of safety circuit
Maintenance operation mode
32
30
Door zone & acceleration sensor
31
State of safety circuit
32
Maintenance operation mode
d1
d2
Receiver at upper end of shaft
313
Transmitter on elevator car
38
Receiver at lower end of elevator shaft
d1
d2
34
36
35

SAFETY DEVICE, SAFETY SYSTEM, AND METHOD FOR SUPERVISING SAFETY OF AN ELEVATOR SYSTEM

This application is a continuation of PCT/FI2006/000027 filed on Jan. 31, 2006, which is an international application claiming priority from FI 20050128 filed Feb. 4, 2005, the entire contents of which are hereby incorporated by reference.

FIELD OF THE INVENTION

The present invention relates to elevator safety systems. In particular, the invention concerns a safety device that makes it possible to integrate elevator safety functions together.

BACKGROUND OF THE INVENTION

An important objective in elevator systems is to maximize passenger safety. The elevator car must never be allowed to fall freely, and its motion must never reach an uncontrolled acceleration of motion or an uncontrolled deceleration of motion. Therefore, the elevator apparatus comprises several different safety and stopping devices which take care of stopping the elevator car in both normal and fault situations.

The elevator control system takes care of driving the elevator from floor to floor. During normal operation, acceleration and deceleration, the elevator control system takes care of, for example, slowing down the speed of the elevator and stopping the elevator at the right floor. The control system also stops the elevator smoothly at the terminal floor. If normal stopping of the elevator by the control system does not work, then smooth stopping of the elevator at the terminal floor is taken care of by a Normal Terminal Slowdown (NTS) function.

If the Normal Terminal Slowdown (NTS) function fails to stop the elevator as it reaches the end of the shaft, then the elevator will be stopped by an Emergency Terminal Speed Limiting (ETSL) function by using the machine brake of the elevator. The machine brake is an electromechanical brake, which is generally arranged to engage the traction sheave of the elevator when necessary. If the deceleration of the elevator is not sufficient, then ETSL can additionally use the brake of the elevator car or the wedge brake, i.e. safety gear, to stop the elevator.

FIG. 1 illustrates the operation of the safety devices of an existing elevator system. The graph 10 represents the movement of the elevator as a function of distance and velocity.

The safety device used may be a mechanical overspeed governor (OSG). The overspeed governor monitors the velocity of the elevator car in the elevator shaft and, if the velocity of the elevator car exceeds a given preset limit value (e.g. 6 m/s), then the overspeed governor will break the safety circuit of the elevator, causing the machine brake to engage (area 12). The elevator has a safety circuit that will break when one of the switches connected to it opens. If the overspeed still goes on increasing, then the overspeed governor will operate the safety gear (area 16) provided in conjunction with the elevator car, the safety gear wedge engaging the elevator guide rails and preventing movement of the elevator car. In other words, if the ropes or rope suspensions fail and the elevator car starts falling freely, then the safety gear will get wedged and seize.

Placed near the end of the elevator shaft is a final limit switch. The position of the final limit switch is indicated by x1 in FIG. 1. If the elevator has not stopped before reaching the final limit switch, then the elevator safety circuit is broken again and the brake of the elevator is activated. The final limit switch uses the machine brake (range 12) to stop the elevator car if the elevator advances e.g. 100 mm beyond the final position.

If the elevator moves on a few centimeters past the final limit switch, then the car (or correspondingly counterweight) will hit a buffer 13, which will finally stop the elevator by a springing action. Even after the buffer there must be an empty space 14, after which the elevator would meet the concrete end structure 15 of the shaft.

Even if the normal control system should fail, full-sized buffers have a sufficient stroke length such that it is in principle safe to run at full speed onto the buffers without the acceleration inside the car exceeding the allowed limit before the elevator car stops. Typically 1 g is an acceleration/deceleration level defined in safety regulations as a value that a human being can withstand.

Figure 2:
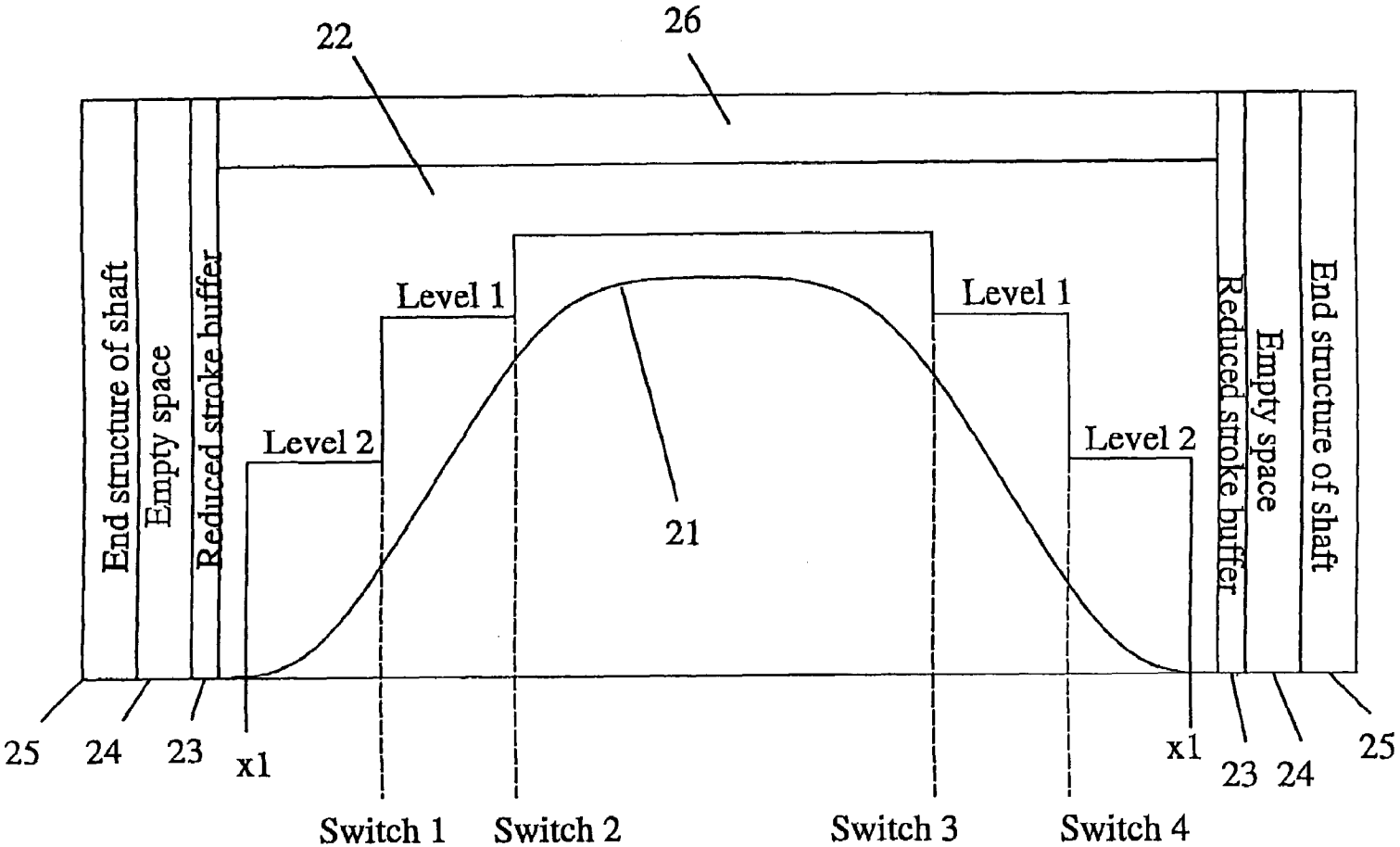
Fig. 2 (Related Art)

FIG. 2 illustrates the operation of the safety system of an elevator when the elevator system uses a so-called reduced-stroke buffer 23. After the buffer 23 there is an empty space 24, which is adjacent to the concrete end structure 25 of the shaft. In this case, the stopping of the car is implemented utilizing an electric safety circuit. Mounted at a certain distance from the end of the shaft is a switch having a speed limit of e.g. 90% of the nominal speed (switch 2 and switch 3). Another switch, having a speed limit of e.g. 60% of the nominal speed (switch 1 and switch 4), is mounted closer to the shaft end. If the speed is over 90% of the nominal speed at the switch (switches 2 and 3), then the safety circuit will be broken again and the machine brake (area 22) will stop the elevator car. If the speed is over 60% of the nominal speed at the switch (switches 1 and 4), then the safety circuit will be broken and the machine brake will stop the elevator car (area 22). If the overspeed still increases from that level, then the elevator's safety system will use the safety gear provided in conjunction with the elevator car to stop the car (area 26).

The authorities of different countries have different regulations regarding the safety of elevators. The basic principle is that the elevator should have a safety system that is capable of stopping the elevator in a fault situation. For example, according to elevator directive 95/16/EC of the European Union, an elevator should be provided with an overspeed governor and a speed monitoring system. The elevator must not reach an uncontrolled acceleration of motion or an uncontrolled deceleration of motion. In addition, in the elevator shaft, between the elevator car and the end of the elevator shaft there must remain buffers and a sufficient safety space.

When elevators are renewed in old buildings, problems often arise because the safety regulations have changed over the years and there are no sufficiently large spaces in the elevator shaft above and below the elevator car as required by the current safety regulations. Extending the shaft upwards or downwards is in most cases impossible in respect of construction engineering or at least so expensive and difficult that it is out of the question.

BRIEF DESCRIPTION OF THE INVENTION

The object of the present invention is to disclose a new type of elevator safety system that will perform the functions of several different safety devices, thus reducing the number of safety devices and increasing the reliability of the safety system. A specific object of the invention is to guarantee overspeed governors as required by the valid safety regulations as well as sufficiently large safety spaces at the top and bottom ends of the elevator shaft.

The method, device, and system of the present application are discussed below. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. In this case, some of the attributes contained in the claims below may be superfluous from the point of view of separate inventive concepts. Within the framework of the basic concept of the invention, features of different embodiments of the invention can be applied in conjunction with other embodiments.

As for the features of the invention, reference is made to the claims.

The present invention concerns a device, a method and a system for improving the safety system of an elevator.

The safety system according to the invention comprises an electric safety device, which monitors the velocity and position of the elevator in the elevator shaft. The safety device is e.g. a computer having two separate processors. Each processor is able to stop the elevator independently using the brake of the hoisting machine or an optional car brake.

The basic idea of the elevator safety system of the invention is to form a continuous limit curve for control of the speed of the elevator. The limit curve defines the limits of allowed elevator motion, which are determined on the basis of the nominal speed of the elevator and the location of the car. In the new safety system, the elevator's speed, direction and distance from the end of the shaft are continuously monitored in the terminal slowdown range as well.

The safety system of the invention comprises measuring means for continuous measurement of elevator motion data and a safety device that receives data about the motion of the elevator, calculates its velocity at each instant of time utilizing the elevator motion data and watches the elevator motion to ensure that it remains within the allowed limit curve. Moreover, the safety system comprises a stopping device for stopping uncontrolled motion of the car if the elevator motion exceeds the limit curve set for it.

In an embodiment of the invention, the limit curve set for the motion of the elevator comprises two separate limit curves. If the elevator motion exceeds a first limit curve, then the safety device of the elevator safety system will use a machine brake braking the rotation of the traction sheave, motor or motor shaft of the elevator to stop the elevator car. If the overspeed condition continues and the elevator motion exceeds a second limit curve, then the safety device of the elevator safety system will use a safety gear connected to an overspeed governor rope and engaging the elevator guide rails to stop the elevator car.

In an embodiment of the invention, the safety device of the elevator safety system comprises at least one connection interface for receiving elevator motion data. The elevator motion data comprises data about the location of the elevator in the elevator shaft and/or data about the acceleration of the elevator in the elevator shaft. In addition, the safety device may comprise connection interfaces for receiving door zone data, data about maintenance operation mode and/or data about the state of the safety circuit.

In maintenance operation mode, when a serviceman is on the top of the car, a sufficient safety space has to be provided at the upper end of the shaft to guarantee safe working conditions. By using the new safety device, the size of the safety space can be reduced because in maintenance operation mode the safety device stops the elevator car by activating the electromechanical brake e.g. 1.4 meters before the end of the shaft. If the electromechanical brake can not stop the elevator, then the safety device can activate the two-way safety gear e.g. 1.2 meters before the end of the shaft. Near the pit of the shaft, the positions of the final limit switches can be changed in the same way, the electromechanical brake is actuated at a distance of 1.4 meters from the end and the safety gear at a distance of 1.2 meters from the end. The elevator can not reach the bottom of the shaft, so there remains a safety space of 1.2 meters below the elevator.

This safety function in maintenance operation mode is extraordinarily useful in cases of modernization where there is not enough safety space in the old elevator shaft. For example, in Europe there are many elevators in which the spaces above/below the car do not meet the present newest elevator safety regulations. By using the safety device, the safety spaces of even old elevators can be made to comply with the newest safety regulations.

The advantages of the invention relate to improved elevator safety and facilitation of renewal of old elevators. The apparatus of the invention does not in itself reduce failure situations in an elevator system, but it can be used to improve the reliability and coverage of the safety system and to facilitate the renewal of old elevators so as to render them compliant with the new safety regulations. Another advantage is simplicity of the equipment, such that it can be easily installed in existing old elevators, in their structures, without making any large and expensive modifications, by using the existing braking devices.

By using the new safety device, the size of the buffers of the elevator can be reduced more than at present. The safety device of the invention allows the number of components required in the installation to be reduced. Safety can be concentrated in one place. The safety device of the invention is designed to integrate several safety functions in a single assembly. Therefore, it is unnecessary to install each safety device separately while the number of components to be installed is reduced.

In new elevators, the above-mentioned safety systems are implemented using suitable devices, which in principle could also be used in old elevators already in use. However, this would require such large changes and additions to the old elevator structures that the elevators would have to be inspected completely anew. In practice, the entire elevators would have to be renewed to such an extent that it might be more economical to build a completely new elevator when evaluated on a longer-term basis.

LIST OF FIGURES

Figure 4:
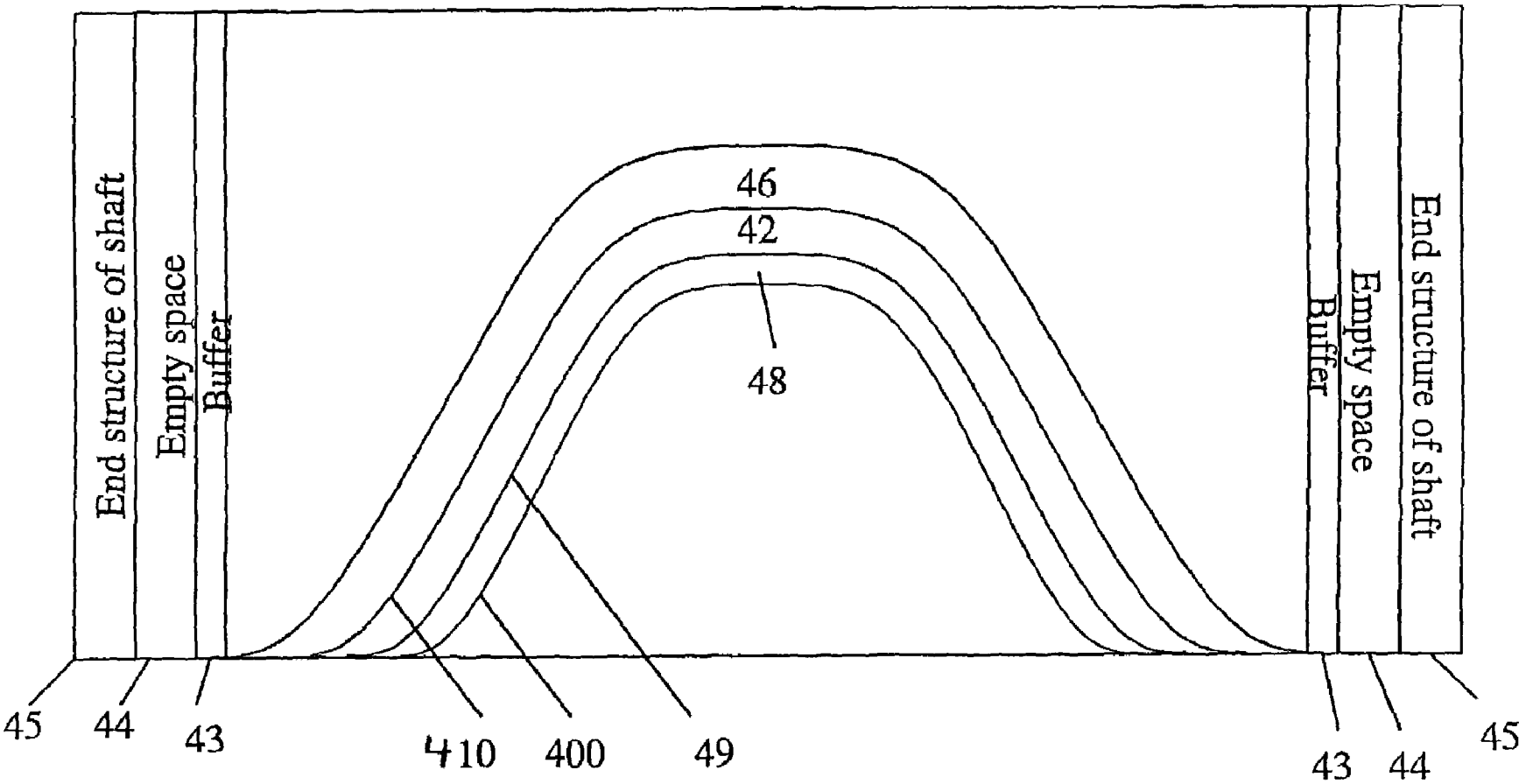
Figure 5:
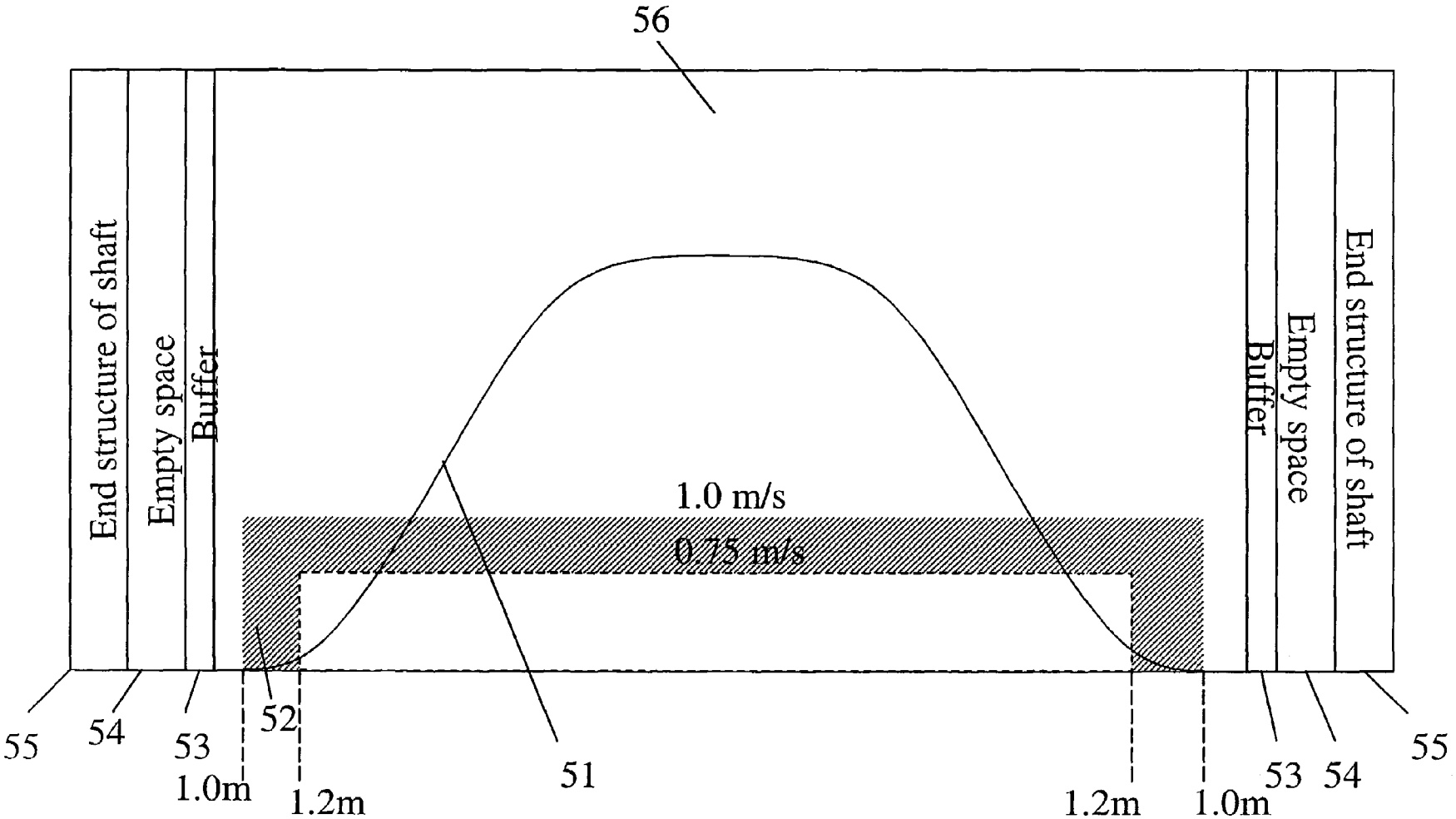
Figure 6:
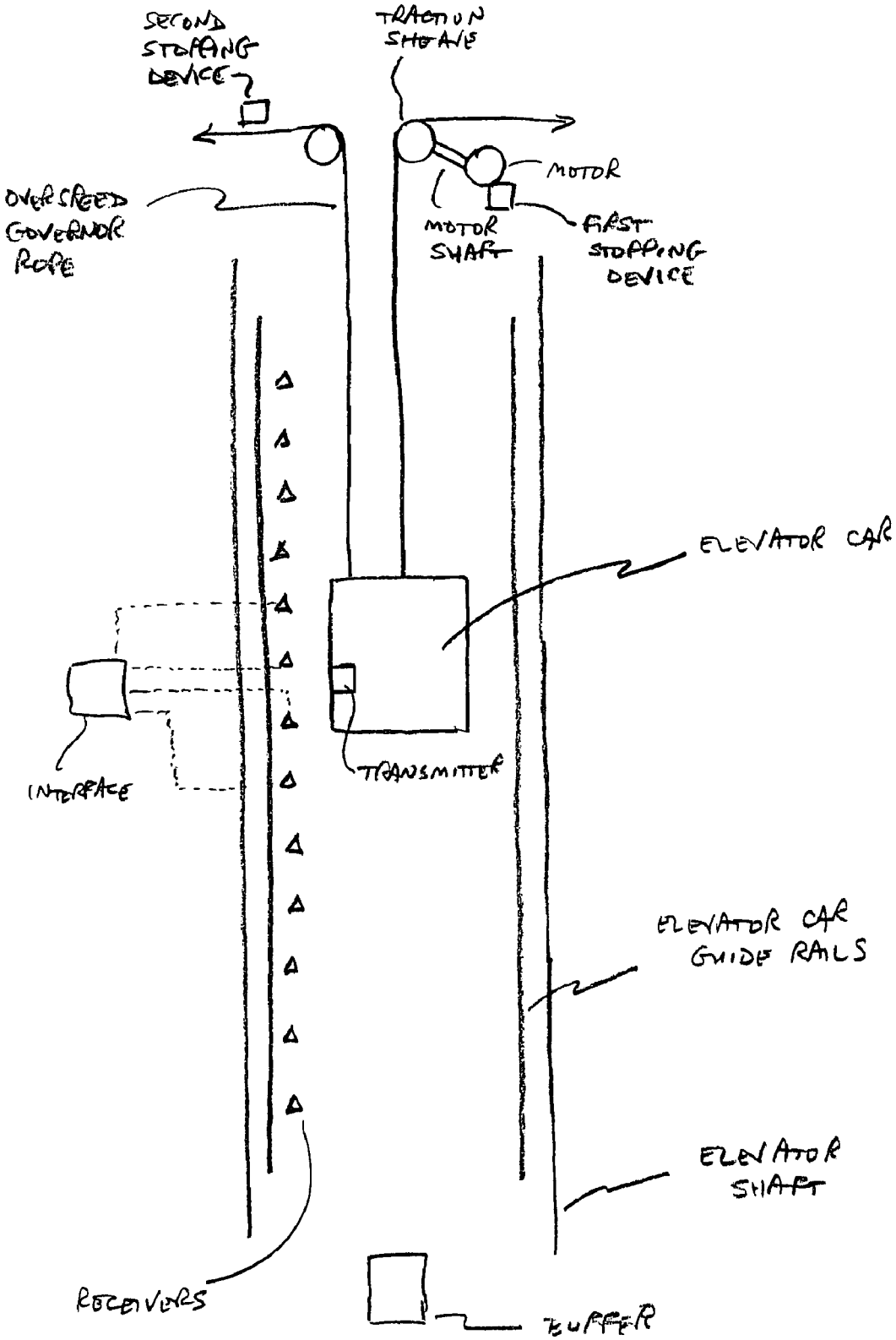

In the following, the invention will be described in detail with reference to embodiment examples, wherein FIGS. 1 and 2 illustrate the operation of prior-art safety devices, FIG. 3 presents an embodiment of the safety system according to the present invention, FIG. 4 presents an embodiment of the safety curve of the safety device of the invention and the operation of the safety devices, FIG. 5 presents an embodiment of the operation of the safety devices in maintenance operation mode, and FIG. 6 presents an embodiment of the invention.

DETAILED DESCRIPTION OF THE INVENTION

FIG. 3 illustrates the operation of the safety system of the invention in a simplified form. In this simplified example, the safety device 301 comprises two separate processors 302 and 303, which monitor the velocity and position of the elevator car in the elevator shaft. The safety device has an interface 30 for receiving door zone data and the data supplied by acceleration sensors. In addition, the safety device has interfaces 31 and 32 for the detection of maintenance operation mode and the state of the safety circuit. The control system and control logic 37 of the elevator take care of controlling the movement of the elevator car 36 from floor to floor and stopping the elevator at the terminal floor via the Normal Terminal Slowdown (NTS) function.

Each processor 302 and 303 independently receives data about the absolute position of the elevator car as well as door zone data indicating the exact location of the door zone of each floor. The location element used to locate the elevator may be e.g. a USP 30 or USP 100 location system of Schmersal AG in duplicate. The location equipment may also consist of some other twin-channel device giving an absolute position, for instance twin-channel laser measurement, ultrasound measurement or elevator position data obtained on the basis of motor speed and a floor code obtained from a magnetic band provided at each floor.

In the Ultraschall-Positionssystem (USP) position measuring system, a transmitter 313 is mounted on the elevator car 36 and receivers are mounted at the lower end 35 and at the upper end 34 of the elevator shaft. The transmitter and receiver are connected by a signal lead 38, into which the transmitter injects ultrasound pulses. The receivers measure the time elapsing during the propagation of the ultrasound pulse and, based on it, determine the position of the elevator car. As the ultrasound pulse propagates from the transmitter in both directions along the signal lead, the distance from the elevator car to both the upper end and the lower end of the shaft is obtained. The sum of these two measurements, d1 and d2, must remain constant. In other words, if one of the channels starts producing incorrect data, the processors 302 and 303 of the safety device will detect this immediately.

If the sum of d1 and d2 is not correct or if either one of the two measurements is missing altogether, then the safety device 301 will go into precautionary mode. In the precautionary mode, the speed of the elevator car is limited to a maintenance operation velocity, and the safety device calculates this velocity and position on the basis of the two acceleration sensors mounted on the elevator car. If the safety device does not receive data about the speed and position of the elevator car from the acceleration sensors, then it will not allow the elevator to move. In this case, the serviceman has to make manual connections in the system using jumper wires so as to allow the elevator to move. Alternatively, the brake can be released manually to allow the elevator to be moved to the level of a floor.

During instruction operation, the safety device is taught the exact locations of the floors. During instruction operation, the elevator is positioned at either the lowest or the highest floor and then driven from end to end, the safety device thus learning the exact locations of the floors from the door zone sensor.

Although the example in FIG. 3 presents a safety device involving a duplicated solution (two separate processors), in other embodiments of the invention it is also possible to use solutions in which the operation of the safety device is not necessarily duplicated. Similarly, the position of the elevator in the elevator shaft may be determined using any suitable equipment.

FIG. 4 presents the limit curve 49 for the safety device of the invention in normal operation. Curve 400 represents the travel of the elevator as a function of distance and time. The figure shows two limit curves 49 and 410 according to an example of the invention. The area 48 between curve 400 and the first limit curve 49 is an intermediate area where safety braking is not yet activated. The safety device calculates the velocity of the elevator continuously on the basis of the elevator position data supplied into the input channels. If the velocity exceeds a given predetermined speed, 6 m/s (curve 49), then the safety device will break the safety circuit and use the machine brake (area 42). If the overspeed still continues after that (curve 410), then the safety device will use the safety gear or a separate car brake to stop the elevator (area 46).

If the elevator moves on a few centimeters after the final limit switch, the car (or likewise the counterweight) will hit the buffer 43, which will finally stop the elevator by a springing action. Even after the buffer there must be an empty space 44, after which the elevator would meet the concrete end structure 45 of the shaft.

FIG. 5 presents the limit curve 51 for the safety device in maintenance operation mode. The processors of the safety device receive data indicating whether the elevator is in maintenance operation mode (i.e., whether the safety space and overspeed of the elevator car are to be limited). The elevator system goes into maintenance operation mode (e.g., in a situation where a serviceman presses the yellow mushroom button on the bottom of the shaft or uses the operating switch for maintenance operation placed on the top of the elevator car). In that situation, the safety device will start limiting the distance from the lower and upper ends of the elevator shaft and impose a speed limit according to the maintenance operation velocity.

According to the safety regulations, the speed limit during maintenance operation is 0.63 m/s in Europe and 0.75 m/s in the USA and Canada. If the maintenance operation mode is active, then the safety device will see to it that the nominal speed of the elevator car will not exceed e.g. 0.75 m/s. For maintenance operation, a sufficient speed limit is 0.75 m/s because in Europe, at least at present, no forced stopping is required during maintenance operation. If the safety device has detected that the elevator system is in maintenance operation mode, then the final limit switch will move e.g. 1.4 meters away from the end of the shaft, thus automatically leaving at the end of the shaft a larger compression space, i.e. safety space for a serviceman. If the speed of the elevator car exceeds the allowed speed (0.75 m/s) during maintenance operation, then the safety device will immediately stop the car using the machine brake (area 52) and near the end of the shaft at the latest 1.2 meters before the end of the shaft.

If there a fault situation in the machine brake or if the friction between the rope suspension and traction sheave of the elevator disappears, then the safety device will stop the elevator car by means of the safety gear (area 56) when the speed of the car exceeds 1.0 m/s and at the latest 1.2 meters before the end of the shaft. As the final limit switch is shifted to a position farther away from the end of the shaft, the space taken up by the elevator in the building can be reduced and safe elevator operation is achieved.

Each processor of the safety device receives data indicating whether the safety circuit is unbroken, i.e. whether the elevator is in operating condition. If the safety circuit is broken, the safety device will detect this immediately, engage the machine brake and stop the elevator car. If the machine brake does not hold or if no friction exists between the hoisting ropes and the traction sheave (there is a fault situation in the hoisting system or brake), the safety device will be able to activate the bi-directional safety gear provided on the car, so the elevator can still be stopped before it reaches the buffers. The safety device can also control some other car brake that will stop the motion of the elevator car independently of rope suspensions and machine brakes.

If the elevator moves on a few centimeters past the final limit switch, then the car (or likewise the counterweight) will hit the buffer 53, which will finally stop the elevator by a springing action. Even after the buffer there must be an empty space 54, after which the elevator would meet the concrete end structure 55 of the shaft.

It is obvious to the person skilled in the art that the invention is not limited to the embodiments described above, in which the invention has been described by way of example, but that many variations and different embodiments of the invention are possible within the scope of the inventive concept defined in the claims presented below.

The invention claimed is:

1. A safety system for supervising safety of an elevator, the safety system comprising:

a safety space in an elevator shaft of the elevator, elevator buffers in the elevator shaft, or the safety space and the elevator buffers in the elevator shaft;

a device adapted to continuously measure absolute position of an elevator car of the elevator in the elevator shaft; and a safety device;

wherein if the safety system comprises the safety space, a size of the safety space is reduced, wherein if the safety system comprises the elevator buffers, a size of the elevator buffers is reduced, wherein the safety device is adapted to:

receive data about the absolute position of the elevator car;

calculate a velocity of the elevator car at each instant of time using the absolute position;

monitor the calculated velocity in order to ensure that the calculated velocity remains within an allowed motion limit curve, wherein the allowed motion limit curve is a function of the absolute position; and control at least one stopping device for stopping uncontrolled motion of the elevator car if the calculated velocity exceeds the allowed motion limit curve.

2. The safety system of claim 1, wherein the device adapted to continuously measure absolute position comprises:

a transmitter mounted on the elevator car; and receivers mounted in the elevator shaft.

3. The safety system of claim 1, wherein the safety device is further adapted to:

receive data about a maintenance operation mode;

wherein when in the maintenance operation mode, the safety device is further adapted to:

compare the absolute position to a first constant that defines a more extensive distance from an end of the elevator shaft, and possibly to a second constant that defines a less extensive distance from the end of the elevator shaft;

activate an electromechanical brake when the elevator car arrives in a shaft area defined by the first constant; and activate a safety gear when the elevator car arrives in a shaft area defined by the second constant.

4. The safety system of claim 1, wherein the allowed motion limit curve determines a speed limit for allowed motion of the elevator car for each instant of time, and wherein the speed limit depends on a nominal speed of the elevator car and the absolute position.

5. The safety system of claim 1, wherein the allowed motion limit curve comprises a first limit curve and a second limit curve.

6. The safety system of claim 5, wherein when the calculated velocity exceeds the first limit curve, the safety device activates a first stopping device, and wherein when the calculated velocity exceeds the second limit curve, the safety device activates a second stopping device.

7. The safety system of claim 6, wherein the first stopping device brakes rotation of a traction sheave of the elevator, a motor of the elevator, or a motor shaft of the elevator.

8. The safety system of claim 6, wherein the second stopping device is a safety gear or other elevator car brake connected to an overspeed governor rope that engages elevator car guide rails of the elevator.

9. The safety system of claim 1, wherein the safety device comprises at least one connection interface for receiving elevator motion data.

10. The safety system of claim 9, wherein the elevator motion data comprises data about the absolute position, data about acceleration of the elevator car in the elevator shaft, or data about the absolute position and data about the acceleration.

11. A safety device for supervising safety of an elevator, the safety device comprising:

at least one connection interface for receiving data about an absolute position of an elevator car of the elevator in an elevator shaft of the elevator;

a device adapted to calculate a velocity of the elevator car based on the absolute position data;

a device adapted to monitor motion of the elevator car in order to keep the motion of the elevator car within an allowed motion limit curve; and a device adapted to control at least one stopping device if the motion of the elevator car exceeds the allowed motion limit curve;

wherein the allowed motion limit curve is a function of the absolute position.

12. The safety device of claim 11, further comprising:

at least one connection interface for receiving data about a maintenance operation mode;

wherein when in the maintenance operation mode, the safety device is adapted to:

compare the absolute position to a first constant that defines a more extensive distance from an end of the elevator shaft, and possibly to a second constant that defines a less extensive distance from the end of the elevator shaft;

activate an electromechanical brake when the elevator car arrives in a shaft area defined by the first constant; and activate a safety gear when the elevator car arrives in a shaft area defined by the second constant.

13. The safety device of claim 11, wherein the allowed motion limit curve determines a speed limit for allowed motion of the elevator car for each instant of time, and wherein the speed limit depends on a nominal speed of the elevator car and the absolute position.

14. The safety device of claim 11, wherein the allowed motion limit curve comprises a first limit curve and a second limit curve.

15. The safety device of claim 14, wherein when the calculated velocity exceeds the first limit curve, the safety device activates a first stopping device, and wherein when the calculated velocity exceeds the second limit curve, the safety device activates a second stopping device.

16. The safety device of claim 15, wherein the first stopping device brakes rotation of a traction sheave of the elevator, a motor of the elevator, or a motor shaft of the elevator.

17. The safety device of claim 15, wherein the second stopping device is a safety gear or other elevator car brake connected to an overspeed governor rope that engages elevator car guide rails of the elevator.

18. The safety device of claim 11, wherein the safety device comprises at least one connection interface for receiving elevator motion data.

19. The safety device of claim 18, wherein the elevator motion data comprises data about the absolute position, data about acceleration of the elevator car in the elevator shaft, or data about the absolute position and data about the acceleration.

20. A method for supervising a safety system of an elevator, the method comprising:

measuring motion data of an elevator car of the elevator in an elevator shaft of the elevator on a continuous basis;

calculating a velocity of the elevator car using the motion data;

controlling motion of the elevator car using a safety device in order to ensure that the motion of the elevator car remains within an allowed motion limit curve; and stopping the elevator car using the safety device if the motion of the elevator car exceeds the allowed motion limit curve;

wherein the motion data includes an absolute position of the elevator car in the elevator shaft, and wherein the safety device comprises at least one stopping device.

21. The method of claim 20, further comprising:

measuring a location of the elevator car in the elevator shaft;

observing when the elevator is in a maintenance operation mode; and when in the maintenance operation mode, comparing the absolute position to a first constant that defines a more extensive distance from an end of the elevator shaft, and possibly to a second constant that defines a less extensive distance from the end of the elevator shaft;

activating an electromechanical brake when the elevator car arrives in a shaft area defined by the first constant; and activating a safety gear when the elevator car arrives in a shaft area defined by the second constant.

22. The method of claim 20, wherein the allowed motion limit curve determines a speed limit for allowed motion of the elevator car for each instant of time, and wherein the speed limit depends on a nominal speed of the elevator car and the absolute position.

23. The method of claim 20, wherein the allowed motion limit curve comprises a first limit curve and a second limit curve.

24. The method of claim 23, wherein a first stopping device is activated if the calculated velocity exceeds the first limit curve, and wherein a second stopping device is activated if the calculated velocity exceeds the second limit curve.

25. The method of claim 24, wherein the first stopping device brakes rotation of a traction sheave of the elevator, a motor of the elevator, or a motor shaft of the elevator.

26. The method of claim 24, wherein the second stopping device is a safety gear or other elevator car brake connected to an overspeed governor rope that engages elevator car guide rails of the elevator.

27. The method of claim 20, wherein the motion data is transmitted to the safety device.

28. The method of claim 20, wherein the motion data includes data about the absolute position, data about acceleration of the elevator car in the elevator shaft, or data about the absolute position and data about the acceleration.

* * * * *